US009802090B2

(12) United States Patent
Becktor et al.

(10) Patent No.: US 9,802,090 B2
(45) Date of Patent: Oct. 31, 2017

(54) GOLF CLUB HEAD

(71) Applicant: Dunlop Sports Co., Ltd., Hyogo (JP)

(72) Inventors: Mika Becktor, Huntington Beach, CA (US); Patrick Ripp, Seal Beach, CA (US)

(73) Assignee: Dunlop Sports Co., Ltd., Hyogo (JP)

( * ) Notice: Subject to any disclaimer, the term of this patent is extended or adjusted under 35 U.S.C. 154(b) by 69 days.

(21) Appl. No.: 15/053,976

(22) Filed: Feb. 25, 2016

(65) Prior Publication Data

US 2017/0246516 A1 Aug. 31, 2017

(51) Int. Cl.
*A63B 53/04* (2015.01)

(52) U.S. Cl.
CPC ..... *A63B 53/047* (2013.01); *A63B 53/04* (2013.01); *A63B 2053/042* (2013.01); *A63B 2053/0408* (2013.01); *A63B 2053/0416* (2013.01); *A63B 2053/0425* (2013.01); *A63B 2053/0433* (2013.01); *A63B 2053/0441* (2013.01); *A63B 2053/0483* (2013.01)

(58) Field of Classification Search
CPC ..... A63B 53/04; A63B 53/047; A63B 2053/0416; A63B 2053/042; A63B 2053/0425; A63B 2053/0433; A63B 2053/0441
USPC ..... 473/342, 344, 345
See application file for complete search history.

(56) References Cited

U.S. PATENT DOCUMENTS

| | | | | |
|---|---|---|---|---|
| 6,093,113 | A * | 7/2000 | Mertens | A63B 53/04 473/328 |
| 7,614,962 | B1 * | 11/2009 | Clausen | A63B 53/047 473/291 |
| 7,846,033 | B2 | 12/2010 | Kato et al. | |
| 8,105,176 | B2 | 1/2012 | Upenieks | |
| 8,152,652 | B2 | 4/2012 | Curtis et al. | |
| 8,197,356 | B2 | 6/2012 | Curtis et al. | |
| 8,251,834 | B2 | 8/2012 | Curtis et al. | |
| 8,262,501 | B2 | 9/2012 | Curtis et al. | |
| 8,388,459 | B2 | 3/2013 | Chuck | |
| 8,414,419 | B2 | 4/2013 | Curtis et al. | |

(Continued)

OTHER PUBLICATIONS

Tour Striker wedge. Information and images available at: http://www.intothegrain.com/tour-striker-review. Jun. 10, 2011.

(Continued)

*Primary Examiner* — Benjamin Layno
(74) *Attorney, Agent, or Firm* — Stetina Brunda Garred and Brucker; Mark B. Garred

(57) ABSTRACT

An iron-type golf club head comprising a topline, a sole in opposed relation to the topline, and a front portion extending from the topline toward the sole. The front portion includes a leading edge, a substantially planar hitting region including a face center, and a peripheral region. The peripheral region at least partially surrounds the hitting region such that the hitting region and the peripheral region define therebetween a visually-recognizable hitting region boundary line including a sole-proximate boundary line segment such that when the club head is oriented in a reference position relative to a virtual ground plane, and in a virtual vertical plane perpendicular to the hitting region and passing through the face center, the sole-proximate boundary line segment is vertically spaced above the leading edge by a distance D1 that is no less than 2.5 mm.

20 Claims, 5 Drawing Sheets

(56) References Cited

U.S. PATENT DOCUMENTS

| | | | | |
|---|---|---|---|---|
| 8,668,599 | B1 * | 3/2014 | Cackett | A63B 53/047 473/335 |
| 2002/0049096 | A1 * | 4/2002 | Doolen | A63B 53/04 473/330 |
| 2004/0242339 | A1 * | 12/2004 | Gilbert | A63B 53/04 473/291 |
| 2014/0018186 | A1 * | 1/2014 | Saito | A63B 53/047 473/349 |
| 2015/0024864 | A1 * | 1/2015 | Jertson | A63B 53/047 473/291 |
| 2017/0095707 | A1 * | 4/2017 | Ripp | A63B 53/047 |

OTHER PUBLICATIONS

Tour Striker 7-iron. Information and images available at: http://www.intothegrain.com/tour-striker-review/. Jun. 10, 2011.

* cited by examiner

GOLF CLUB HEAD

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to a golf club head, and more particularly to an iron-type golf club head having a visually recognizable feature which causes players to "forward press" a corresponding golf club at address and hit down on the golf ball at impact.

2. Description of the Related Art

Proper contact between a golf club head and a golf ball is imperative to produce a successful golf shot. For some types of golf club heads, particularly for some types of iron-type golf club heads, proper contact typically results when a golfer "hits down" on the golf ball. While professionals and experienced golfers are capable of "hitting down" on the golf ball with regularity, inexperienced golfers are typically unable hit down on the golf ball with regular consistency.

One reason why inexperienced golfers may struggle with hitting down on the golf ball is that they have a fundamental misunderstanding of what it means to hit down on the ball. Generally speaking, to "hit down" on the golf ball requires the club head to have a downward angle of attack at the time of impact with the golf ball. The angle of attach relates to swing arc of the golf club, and more specifically, where along the swing arc the club head strikes the golf ball. If the club head strikes the golf ball before the club head reaches its lowest point, the club head has a downward angle of attack, which is associated with the golfer hitting down on the golf ball. Conversely, if the golf ball is struck after the club head reaches its low point, the club head has an upward angle of attack, which is associated with the golfer hitting up on the golf ball. When the golf ball is lying on the ground, the club head must typically strike the golf ball before the low point, thereby requiring a downward angle of attack.

To create a downward angle of attack, the golfer's hands typically remain in front of the club head at impact. Many novice golfers lack the skill for regularly keeping their hands in front of the club head at impact, which leads to undesirable results.

Accordingly, there is a need in the art for a golf club head which urges a golfer to position their hands in a forward position during impact. Various aspects of the present disclosure address this particular need, as will be discussed in more detail below.

BRIEF SUMMARY

In accordance with one embodiment of the present disclosure, there is provided an iron-type golf club head comprising a topline, a sole in opposed relation to the topline, and a front portion extending from the topline toward the sole. The front portion includes a leading edge, a substantially planar hitting region including a face center, and a peripheral region. The peripheral region at least partially surrounds the hitting region such that the hitting region and the peripheral region define therebetween a visually-recognizable hitting region boundary line including a sole-proximate boundary line segment such that when the club head is oriented in a reference position relative to a virtual ground plane, and in a virtual vertical plane perpendicular to the hitting region and passing through the face center, the sole-proximate boundary line segment is vertically spaced above the leading edge by a distance D1 that is no less than 2.5 mm.

The peripheral region may be angularly offset from the hitting region such that the sole-proximate boundary line segment comprises an angular junction between the peripheral region and the hitting region. The peripheral region may also be substantially co-planar with the hitting region.

The hitting region may define a first surface finish and the peripheral region may define a second surface finish different from the first surface finish to create the visually-recognizable boundary line between the hitting region and the peripheral region.

When the club head is oriented in the reference position and in the virtual vertical plane, the sole-proximate boundary line segment may be vertically spaced above the ground plane by at least 7 mm. The distance D1 may be no less than 4 mm. The iron-type golf club head may further comprise a loft angle of no less than about 40 degrees.

According to another embodiment, there is provided an iron-type golf club comprising a golf club head including a topline, a sole in opposed relation to the topline, and a front portion extending from the topline toward the sole. The front portion includes a leading edge, a substantially planar hitting region including a face center, and a peripheral region at least partially surrounding the hitting region such that the hitting region and the peripheral region define therebetween a visually-recognizable hitting region boundary line including a sole-proximate boundary line segment. When the club head is oriented in a reference position relative to a virtual ground plane, and in a virtual vertical plane perpendicular to the hitting surface and passing through the face center, the sole-proximate boundary line segment is vertically spaced above the virtual ground plane by distance D2 between 4 mm and 12 mm. The iron-type golf club further includes a golf shaft secured to the golf club head, and a negative face angle.

The distance D2 may be no less than 7 mm.

There is also provided an iron-type golf club head comprising a topline, a sole in opposed relation to the topline; and a front portion extending from the topline toward the sole. The front portion includes a leading edge, a substantially planar hitting region including a face center and comprising a first surface finish, and a peripheral region at least partially surrounding, and coplanar with, the hitting region. The peripheral region comprises a second surface finish such that the hitting region and the peripheral region define therebetween a visually-recognizable hitting region boundary line that includes a sole-proximate boundary line segment such that, when the club head is oriented in a reference position relative to a virtual ground plane, and in a virtual vertical plane perpendicular to the hitting surface and passing through the face center, the sole-proximate boundary line segment is vertically spaced above the leading edge by a distance D1 no less than 2.5 mm.

The distance D1 may be no less than 7 mm.

The first surface finish may comprise a media-blasted surface or a milled surface. The second surface finish may comprise a finish selected from the group consisting of: a physical vapor deposited coating, a polished metallic coating, a black-colored coating, an anodized coating, a laser-etched coating, and a chemically-etched coating.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
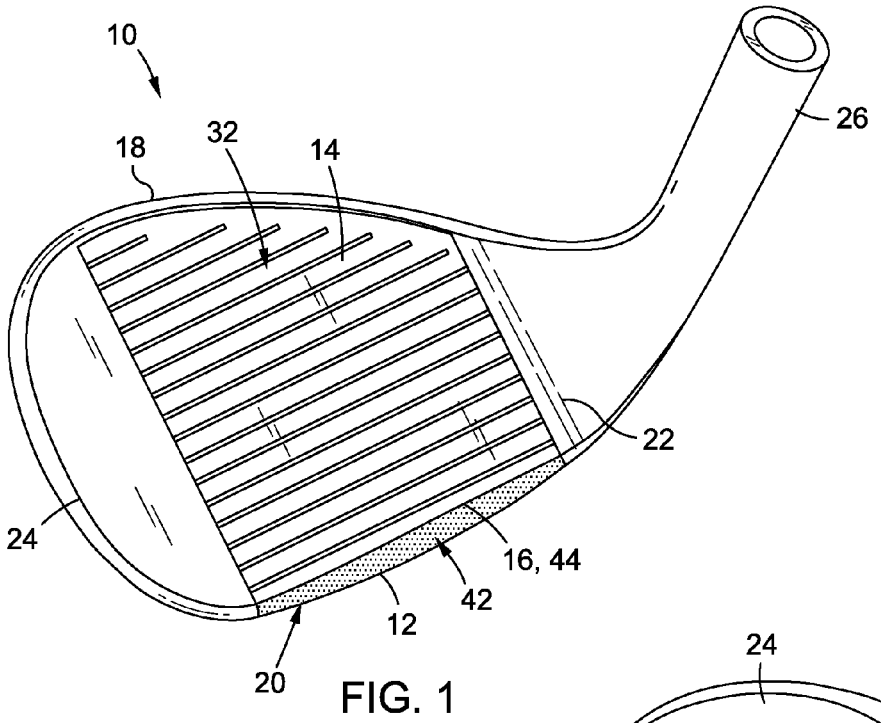
FIG. 1 is an upper perspective view of an iron-type golf club head according to one or more embodiments.
Figure 2:
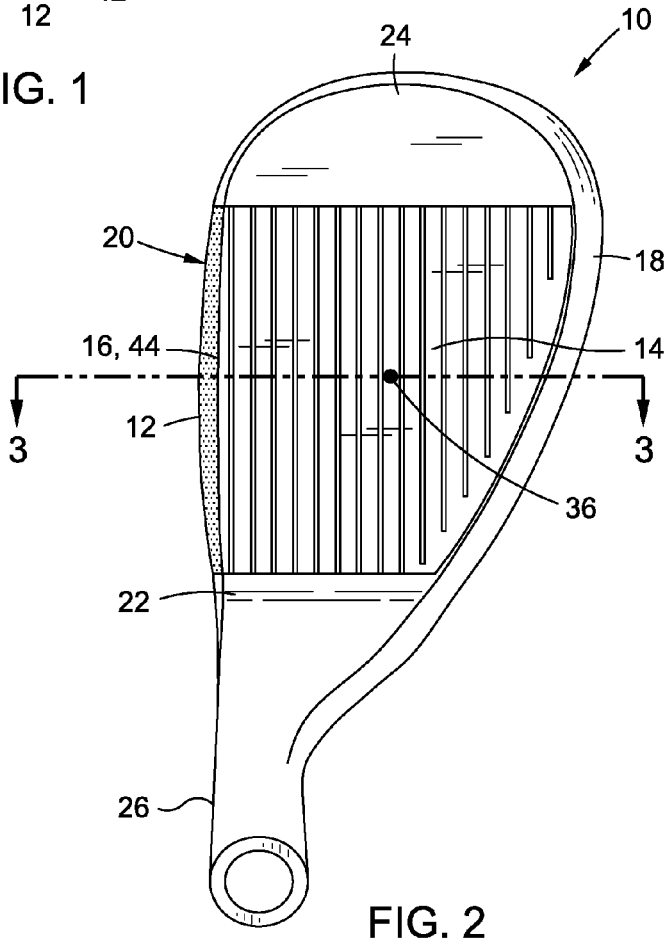
FIG. 2 is a top view of the iron-type golf club head depicted in FIG. 1.

The detailed description set forth below in connection with the appended drawings is intended as a description of certain embodiments of an iron-type golf club head and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. For example, while the present disclosure find particularly utility in relation to wedge type golf clubs, the structural and functional features described below may be applied to other type of golf club heads as well. It is further understood that the use of relational terms such as first and second, and the like are used solely to distinguish one entity from another without necessarily requiring or implying any actual such relationship or order between such entities. All recitations of parameter values as "approximate" values are intended to serve as implicit recitations of the precise values of such parameters as optional characteristics of the one or more embodiments to which they pertain.

Referring now to the drawings, wherein the showings are for purposes of illustrating a preferred embodiment of the present disclosure, and is not for purposes of limiting the same, there is depicted an iron-type golf club head 10. In some embodiments, the golf club head 10 may be used in connection with a "game improvement" type golf club, wherein the club head 10 is specifically configured and adapted to encourage a golfer to hit down on a golf ball by urging the golfer to press forward at impact with a golf ball. To that end, the club head 10 generally includes a leading edge 12, and a hitting region 14 having a lower boundary 16, with the club head 10 being physically configured give the appearance of the lower boundary 16 being offset from the leading edge 12. Thus, when the golfer looks down at the club head 10 when addressing the golf ball, the lower edge 16 of the hitting region 14 appears to be positioned up on the club head 10. Therefore, the golfer is urged to compensate for the offset position of the lower edge 16 of the hitting region 14 by pressing forward at impact.

According to one embodiment and referring specifically to FIGS. 1-6, the club head 10 includes a topline 18, a sole 20 in generally opposed relation to the topline 18, a heel portion 22, and a toe portion 24 in generally opposed relation to the heel portion 22. A hosel 26 extends from the heel portion 22 along a hosel axis 28. The hosel 26 is adapted to allow the club head 10 to be attached to a golf club shaft 29, such that the shaft and the club head 10 collective define a golf club. The club head 10 further includes a front portion 32 and a rear portion 34, both of which extend from the topline 18 toward the sole 20 in opposed relation to each other. The front portion 32 includes the hitting region 14, which is substantially planar and includes a face center 36. The hitting region 14 is adapted to strike the golf ball and may be textured to impart desired spin characteristics on the golf ball in response to such impact. For instance, in the exemplary embodiment, the hitting region 14 includes a plurality of score lines for imparting spin on the golf ball. Alternatively or in addition, the substantially planar hitting region 14 may include one or more face grooves, texture ridges, and/or a media-blasted surface.

Figure 3:
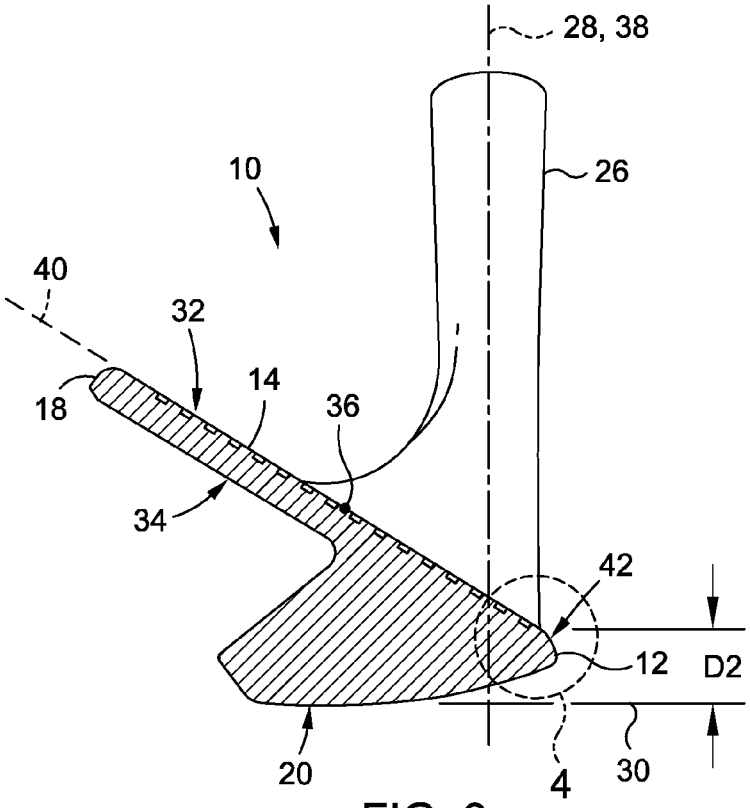
FIG. 3 is a cross-sectional toe side view of an iron-type golf club head taken through Plane 3-3 of FIG. 2.
Figure 4:
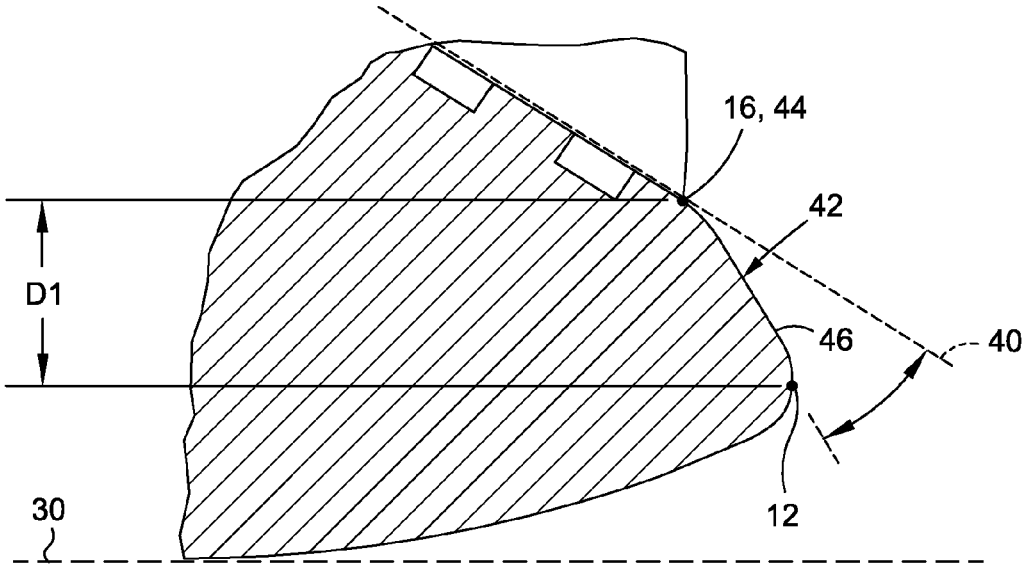
FIG. 4 is a detailed cross-sectional view of a portion of the iron-type golf club head of FIG. 3.

Referring now specifically to FIG. 3, the golf club head 10 is shown in a "reference position." As used herein, "reference position" denotes a position of the golf club head 10 in which at least a portion of the sole 20 contacts a virtual ground plane 30 such that the hosel axis 28 lies in a virtual vertical hosel plane 38 at the club head's designated lie angle, and the hosel plane 121 contains an imaginary horizontal line 122 that is parallel to the imaginary striking face plane 113. Unless otherwise indicated, all parameters herein are specified with the golf club head 100 in the reference position. According to one embodiment, when the club head 10 is oriented in the reference position, the sole 20 preferably contacts the virtual ground plan 30 at a point heel-ward of the face center.

As noted above, the club head 10 further includes a leading edge 12, which is the forward-most edge when the club head 10 is oriented in the reference position. In the exemplary embodiment, the leading edge 12 resides at the intersection of the front portion 32 and the sole 20.

The club head 10 additionally comprises a peripheral region 42 at least partially surrounding the hitting region 14 and having a portion adjacent the sole 20. The hitting region 14 and the peripheral region 42 are configured such that the hitting region 14 and the peripheral region 42 define therebetween a visually-recognizable hitting region boundary line 16 including a sole-proximate boundary line segment 44. According to one embodiment, when the club head 10 is oriented in the reference position relative to the virtual ground plane 30, and in a virtual vertical plane perpendicular to the hitting region 14 and passing through the face center 36, the sole-proximate boundary line segment 44 is vertically spaced from the leading edge 12 by a distance D1 (see FIG. 4). In one particular implementation, the distance D1 is no less than 2.5 mm, while in other embodiments, the distance D1 is no less than 4.0 mm. Furthermore, and referring specifically to FIG. 3, the sole-proximate boundary line segment 44 is vertically spaced from the ground plane 30 by a distance, D2. According to one embodiment D2 is between approximately 4.0 mm and 12.0 mm, and more preferably equal to at least 7.0 mm, and still more preferably equal to approximately 10.0 mm. These ranges provide for offset sufficient to incent "forwarding pressing," yet neither substantially detract from the forgiveness of the club head nor distract the golfer's attention when viewing the club head at address.

Specifically, the unique location of the sole-proximate boundary line segment 44 relative to the ground plane 30 and the leading edge 12 creates a physical characteristic on the club head 10 which gives the impression to the golfer that the bottom of the hitting region 14 is raised or spaced from the leading edge 12 and the ground plane 30 more than a conventional iron-type golf club. This unique physical characteristic is perceived by the golfer when addressing the golf ball, and urges the golfer to forward press on the golf club when addressing the golf ball and hit down on the golf ball when swinging the golf club.

In the particular embodiment shown in FIGS. 1-6, the peripheral region 42 comprises a grind surface 46 angularly offset from the hitting region 14 forming an angular junction between the peripheral region 42 and the hitting region 14. In one implementation, the grind surface 46 extends from the sole-proximate boundary line segment 44 and away from the hitting region 14 and the front plane 40, such that in a vertical plane which is perpendicular to the front plane 40 and in which at least a portion of both the leading edge 12 and the topline 18 reside, the distance between the grind surface 46 and the front plane 40 increases toward the ground plane from the sole-proximate boundary line segment 44 to the leading edge 12. In some embodiments, the grind surface 46 optionally has a slight curvature to define an arcuate surface. In some such embodiments, the camber (or radius of curvature) of the grind surface 46 varies from the sole-proximate boundary line segment 44 to the leading edge 12. The camber of the grind surface 46 may for example be at a minimum at the sole-proximate boundary line segment 44 and be at a maximum at the leading edge 12. Although the grind surface 46 depicted in FIG. 1-6 is an arcuate surface, it is also contemplated that in other embodiments, the grind surface 46 is substantially linear as it extends from the sole-proximate boundary line segment 44 to the leading edge 12. In this regard, the grind surface 46 may define several configurations without departing from the spirit and scope of the present disclosure.

It is understood that the club head 10 having the uniquely configured hitting region 14 and peripheral region 42 may be suitable for iron-type club heads, and in particular, in a chipper-style golf club head. This is because, in part, chipper-style golf club heads, given their typical lofts, structure and function, typically necessitate forward-pressing. Chipper-style golf club heads may be characterized by a loft angle greater than 40 degrees, and/or a sole-ground contact point (when the club head is oriented in a reference position) that is heelward of the face center of the striking face. Preferably, the sole-ground contact point is laterally spaced from the face center, in the heelward direction, by a distance no less than 2 mm, even more preferably, no less than 4 mm.

Figure 7:
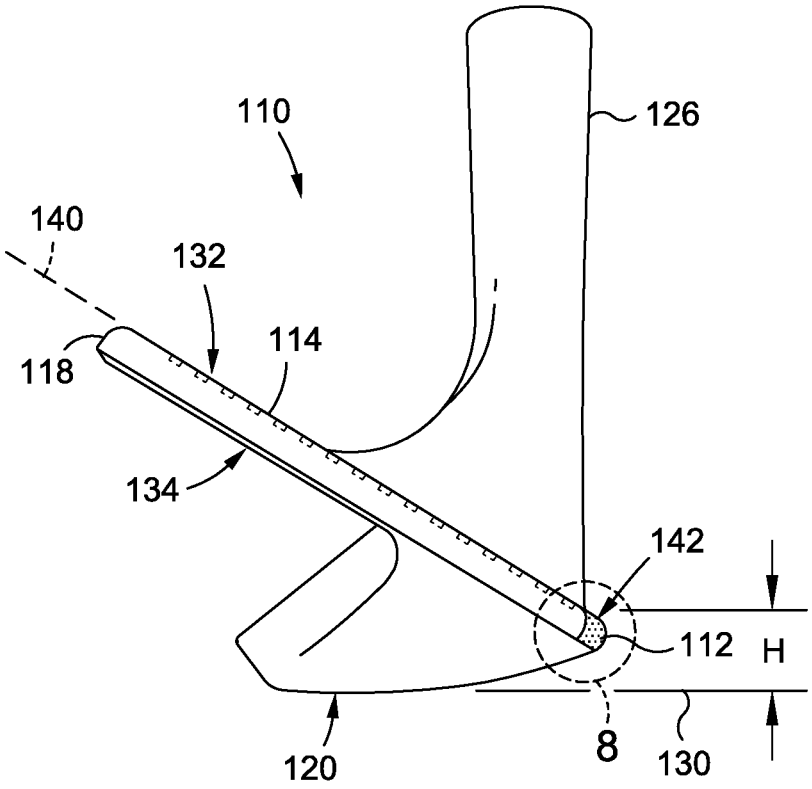
FIG. 7 is a toe side view of an iron-type golf club head according to one or more embodiments.
Figure 8:
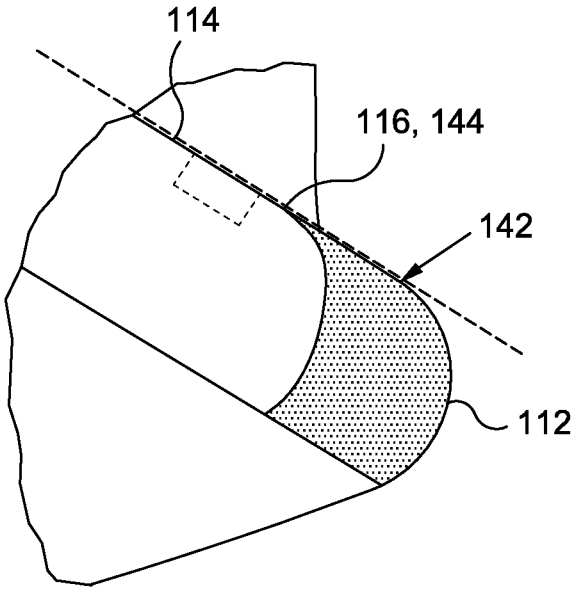
FIG. 8 is a detailed view of a portion of the iron-type golf club head of FIG. 5.

Referring now to FIGS. 7 and 8, there is depicted another embodiment of an iron-type golf club head 110, specifically configured and adapted to provide a visual impression to the golfer of a raised leading edge, wherein the visual impression is created by imparting different finishes or textures on the hitting region and the peripheral region.

The club head 110 includes a topline 118, a sole 120, a front portion 132, and a rear portion 134. The front portion 132 includes a hitting region 114 and a peripheral region 142 at least partially surrounding the hitting region 114. In particular, a portion of the peripheral region 142 extends from the hitting region 114 toward the sole 120. As shown in FIGS. 7 and 8, the peripheral region 142 includes a surface that is substantially co-planar with the hitting region 114. As shown in FIG. 8, the surface of the peripheral region 142 that is substantially co-planar with the hitting region 114 is adjacent the hitting region 114 and is sandwiched between the hitting region 114 and a filleted region that joins the front portion 132 with the sole 120 and that includes a leading edge 112.

The hitting region 114 and the peripheral region 142 define therebetween a visually-recognizable boundary line 116 having a sole-proximate boundary line segment 144. In the embodiment depicted in FIGS. 7 and 8, the visually-recognizable boundary line 116 is defined by different surface finishes on the hitting region 114 and the peripheral region 142. More specifically, the hitting region 114 defines a first surface finish while the peripheral region 142 defines a second surface finish different from the first surface finish to create the visually-recognizable boundary line 116. According to one embodiment, the first surface finish comprises a media-blasted surface or a face-milled surface, while the second surface finish may comprise one of the following finishes: a physical vapor deposited coating, a polished metal coating, a black-colored coating, an anodized coating, a laser-etched coating, and a chemically-etched coating. The location and configuration of the boundary line 116 is preferably similar to those locations and configurations described with regard to the embodiments shown in FIGS. 1-6.

Figure 9:
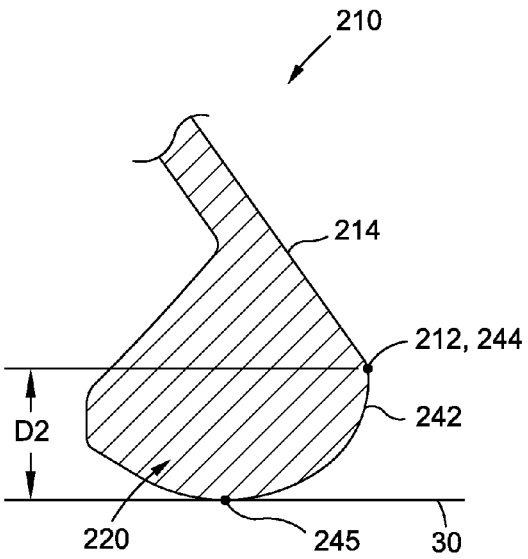
FIG. 9 is a partial, cross sectional view of an iron-type club head that is of a first configuration.

Referring now to FIGS. 9-12, there is depicted several configurations of club heads adapted to create a visually-recognizable hitting region boundary line between a hitting region and a peripheral region, which urges the user to hit down on the ball with the club shaft leaning forward. The configurations shown in FIGS. 9-12 primarily illustrate various alternative manners in which a visually-recognizable sole-proximate hitting region boundary line may be formed. Referring first to FIG. 9, a partial cross sectional view of a club head 210 is shown, with a portion of the sole 220 contacting the ground plane 30. The club head 210 includes a hitting region 214 and a peripheral region 242, wherein the peripheral region 242 may include part of the sole 220, or may transition into the sole 220. A boundary line 244 extends between the hitting region 214 and the peripheral region 242 is coincident with a leading edge 212, i.e., the boundary line 244 and leading edge 212 are not spaced from each other. The sole 220 is configured to have an accentuated camber, meaning that the sole 220 has a relatively large degree of curvature, particularly in a front-to-back direction. For example, the sole exterior surface, in the vertical cross-section passing through the face center, may have a radius of curvature that is no greater than 6 in, more preferably no greater than 4 in, and even more preferably no greater than 3 in. In some such embodiments, the front-to-rear sole camber varies in radius of curvature. Preferably, the radius of curvature decreases forwardly, e.g., from a first rearward radius of curvature no less than 4 in to a second forward radius of curvature no greater than 4 in. Alternatively, or in addition, a difference between a first rearward radius of curvature and a second forward radius of curvature is no less than about 0.50 in, and more preferably no less than about 1.0 in. These configurations ensure that the necessary locations of the boundary line 212 could be achieved while maintaining a traditional overall club head appearance. However, in other embodiments, the front-to-rear sole camber (including as exhibited in a vertical virtual plane passing through the face center when the club head is oriented in the reference position) comprises a substantially constant radius of curvature from the rearward end to the forward end of the sole. By "substantially," slight variation may be assumed as a result of, e.g., typical manufacturing tolerances, engraved indicia on the sole exterior surface, and/or a junction between the sole and striking face being conventionally radiused. Alternatively or in addition, the sole 220 includes a front-to-rear lateral sole length (i.e., parallel to the ground plane 30 and measured in the vertical virtual plane passing through the face center when the club head is oriented in the reference position) of no less than 0.5 in, more preferably within the range of about 0.50 in to about 1.2 in. These configurations ensure that, despite adjustment to the boundary line 244, the club head appears and has a feel similar to a similarly lofted conventional club head. In the exemplary configuration, the portion of the club head 210 extending from a ground contact point 245 to the leading edge/boundary line 212, 244 is arcuate within the cross section shown in FIG. 9. The accentuated camber spaces the boundary line 244 above the ground plane by the distance D2. The elevated location of the boundary line 244 creates an impression in the mind of the golfer which urges the golfer to forward press to compensate for the elevated location of the boundary line, thereby increasing the likelihood that the golfer will hit down on the golf ball.

Figure 10:
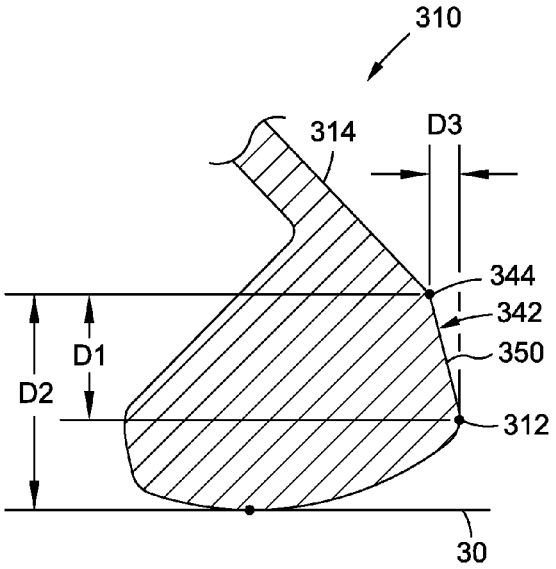
FIG. 10 is a partial, cross sectional view of an iron-type club head that is of a second configuration.

Referring now to FIG. 10, a club head 310 defines a leading edge 312 and includes a hitting region 314 and a peripheral region 342 defining a boundary line 344 therebetween. In a virtual vertical plane perpendicular to the hitting region 314, the boundary line 344 is vertically spaced above the leading edge 312 by the distance D1, as described above. Furthermore, in that same virtual vertical plane, the boundary line 344 is vertically spaced above the ground plane 30 by the distance D2, as described above. Furthermore, the leading edge 312 is horizontally/forwardly spaced from the boundary line by a distance D3. The displacement of the leading edge 312 from the boundary line 344 results in the club head 310 also including a grind face 350, which forms a portion of the peripheral region 342. The grind face 350 is angled from the hitting region 341 to accentuate the boundary line 344, which tends to urge the golfer to forward press to compensate for the elevated location of the boundary line and hit down on the golf ball. It is understood that the grind face 350 may optionally have a surface finish which differs from the hitting region 314 to further accentuate the boundary line 344, although different surface finishes are not required. In the particular embodiments shown in FIG. 10, the sole front-to-rear camber preferably exhibits a front-to-rear sole camber (including as exhibited in a vertical virtual plane passing through the face center when the club head is oriented in the reference position) having a substantially constant radius of curvature from the rearward end to the forward end of the sole. By "substantially," slight variation is assumed by, e.g., typical manufacturing tolerances, engraved indicia on the sole exterior surface, and/or a junction between the sole and striking face being conventionally radiused. The front-to-rear sole camber may have a radius of curvature that is no greater than 6 in, more preferably no greater than 4 in, and even more preferably no greater than 3 in. These configurations ensure that, despite adjustment to the location of the boundary line 344, the club head has an appearance and a feel similar to a similarly-lofted conventional club head. In some such embodiments, however, the front-to-rear sole camber varies in radius of curvature. In such cases, preferably, the radius of curvature decreases forwardly, e.g. from a first rearward radius of curvature no less than 4 in to a second forward radius of curvature no greater than 4 in. Alternatively, or in addition, a difference between a first rearward radius of curvature and a second forward radius of curvature is no less than about 0.50 in, and more preferably no less than about 1.0 in. These configurations ensure that the necessary locations of the boundary line 344 could be achieved while maintaining a traditional overall club head appearance. Alternatively or in addition, the sole includes a front-to-rear lateral sole length (i.e. parallel to the ground plane 30 and measured in the vertical virtual plane passing through the face center when the club head is oriented in the reference position) of no less than 0.5 in, more preferably within the range of about 0.50 in to about 1.2 in.

Figure 11:
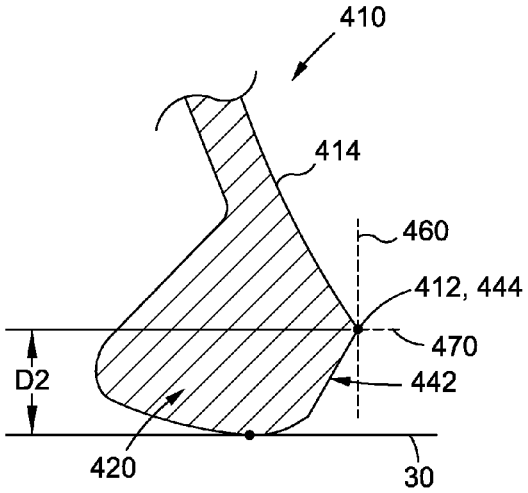
FIG. 11 is a partial, cross sectional view of an iron-type club head that is of a third configuration.

Referring now to FIG. 11, the club head 410 defining a leading edge 412 and including a hitting region 414 and a peripheral region 442 defining a boundary line 444 therebetween. The peripheral region 442 extends from the boundary line 444 towards the sole 420 in a rearward direction, such that the leading edge 412 is coincident with the boundary line 444. Furthermore, the unique configuration of the hitting region 414 and the peripheral region 442 results in the hitting region 414 and peripheral region 442 being on the same side of a vertical plane 460 passing through the boundary line 444 and being parallel to the hosel plane, and an opposite sides of a horizontal plane 470 passing through the boundary line 444. The sole 420 of the embodiments shown in FIG. 11 are preferably configured in similar manner to the sole 320 of the embodiments described with regard to FIG. 10.

Figure 12:
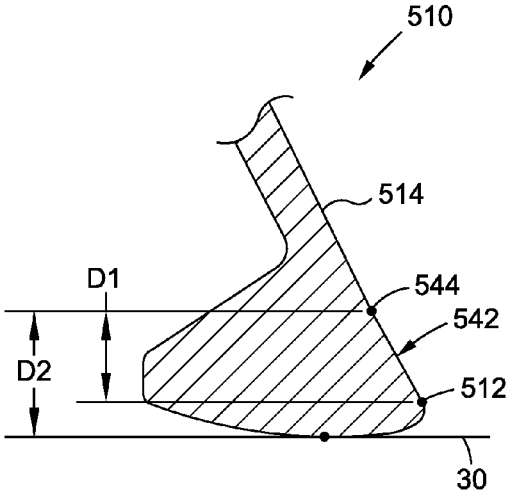
FIG. 12 is a partial, cross sectional view of an iron-type club head that is of a fourth configuration.

Referring now to FIG. 12, there is depicted a club head 510 defining a leading edge 512 and having a hitting region 514 and a peripheral region 542 substantially co-planar with the hitting region 514. The club head 510 is specifically configured such that the hitting region 514 defines a first surface finish and the peripheral region defining a second surface finish different from the first surface finish to create a visually perceptibly boundary line 544 between the hitting region 514 and the peripheral region 542. In this regard, the front region of the club head 510 may be substantially planar, with the hitting region 514 and peripheral region 542 residing within a common plane, along with the boundary line 544 and leading edge 512. The sole of the embodiments shown in FIG. 11 are preferably configured in similar manner to the sole 320 of the embodiments described with regard to FIG. 10.

Figure 5:
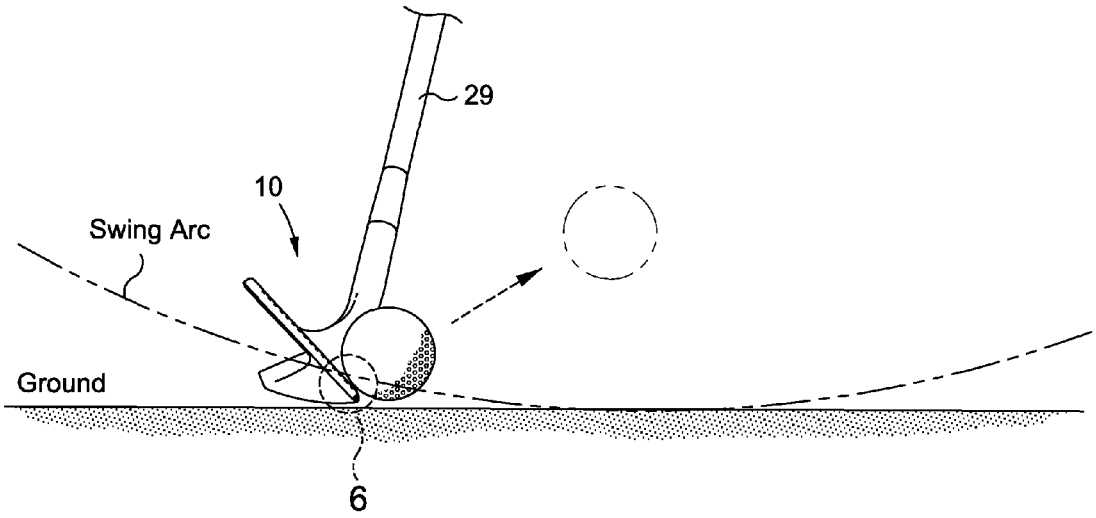
FIG. 5 is a toe side view of a golf club having the iron-type golf club head depicted in FIG. 1 striking a golf ball.
Figure 6:
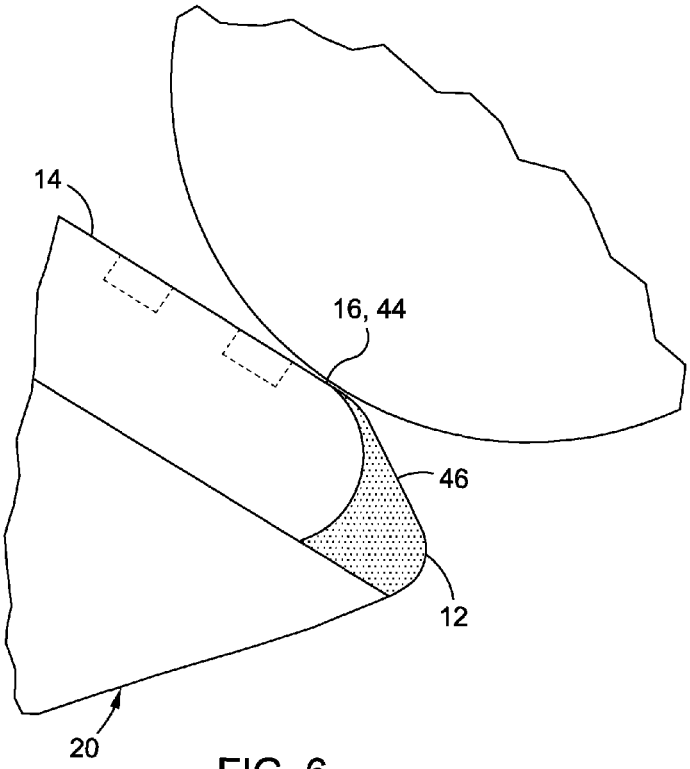
FIG. 6 is a detailed view of a portion of the iron-type golf club head of FIG. 5 depicting contact between the golf club head and the golf ball.

When a golfer uses a golf club including the club heads described above, the golfer will address the golf ball by placing the club head in the reference position adjacent the golf ball. As the golfer looks down at the club head, the sole-proximate boundary line segment will appear to be elevated above the ground plane by a distance which is larger than conventional club heads of similar loft. As the golfer swings the golf club, the golfer may try to compensate for the elevated sole-proximate boundary line segment by keeping the golfer's hands in front of the club head 10 at impact, which enhances the ability of the golfer to hit down on the ball, as is illustrated in FIGS. 5 and 6.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. An iron-type golf club head comprising:

a topline;

a sole in opposed relation to the topline; and a front portion extending from the topline toward the sole, the front portion including a leading edge, a substantially planar hitting region including a face center, and a peripheral region at least partially surrounding the hitting region such that the hitting region and the peripheral region define therebetween a visually-recognizable hitting region boundary line including a sole-proximate boundary line segment such that when the club head is oriented in a reference position relative to a virtual ground plane, and in a virtual vertical plane perpendicular to the hitting region and passing through the face center, the sole-proximate boundary line segment is vertically spaced above the leading edge by a distance D1 that is no less than 2.5 mm.

2. The iron-type golf club head recited in claim 1, wherein the distance D1 is no less than 4 mm.

3. The iron-type golf club head recited in claim 1, wherein the peripheral region is angularly offset from the hitting region such that the sole-proximate boundary line segment comprises an angular junction between the peripheral region and the hitting region.

4. The iron-type golf club head recited in claim 1, wherein at least a portion of the peripheral region is substantially co-planar with the hitting region.

5. The iron-type golf club head recited in claim 1, wherein the hitting region defines a first surface finish and the peripheral region defines a second surface finish different from the first surface finish to create the visually-recognizable boundary line between the hitting region and the peripheral region.

6. The iron-type golf club head recited in claim 1, wherein when the club head is oriented in the reference position and in the virtual vertical plane, the sole-proximate boundary line segment is vertically spaced above the ground plane by at least 7 mm.

7. The iron-type golf club head recited in claim 1, further comprising a loft angle of no less than about 40 degrees.

8. A golf club including the iron-type golf club head recited in claim 1, the golf club further comprising a golf shaft and a negative face angle.

9. An iron-type golf club comprising:

a golf club head comprising:

a topline;

a sole in opposed relation to the topline; and a front portion extending from the topline toward the sole, the front portion including a leading edge, a substantially planar hitting region including a face center, and a peripheral region at least partially surrounding the hitting region such that the hitting region and the peripheral region defining therebetween a visually-recognizable hitting region boundary line including a sole-proximate boundary line segment such that when the club head is oriented in a reference position relative to a virtual ground plane, and in a virtual vertical plane perpendicular to the hitting surface and passing through the face center, the sole-proximate boundary line segment is vertically spaced above the virtual ground plane by distance D2 between 4 mm and 12 mm;

a golf shaft secured to the golf club head; and a negative face angle.

10. The iron-type golf club head recited in claim 9, wherein the distance D2 is no less than 7 mm.

11. The iron-type golf club head recited in claim 9, wherein the peripheral region is angularly offset from the hitting region such that the sole-proximate boundary line segment comprises an angular junction between the peripheral region and the hitting region.

12. The iron-type golf club head recited in claim 9, wherein the peripheral region is substantially co-planar with the hitting region.

13. The iron-type golf club head recited in claim 9, further comprising a loft angle no less than about 40 degrees.

14. The iron-type golf club head recited in claim 9, wherein the hitting region defines a first surface finish and the peripheral region defines a second surface finish different from the first surface finish to create the visually-recognizable hitting region boundary line.

15. An iron-type golf club head comprising:

a topline;

a sole in opposed relation to the topline; and a front portion extending from the topline toward the sole, the front portion including:

a leading edge;

a substantially planar hitting region including a face center and comprising a first surface finish; and a peripheral region at least partially surrounding, and coplanar with, the hitting region, the peripheral region comprising a second surface finish such that the hitting region and the peripheral region define therebetween a visually-recognizable hitting region boundary line that includes a sole-proximate boundary line segment such that, when the club head is oriented in a reference position relative to a virtual ground plane, and in a virtual vertical plane perpendicular to the hitting surface and passing through the face center, the sole-proximate boundary line segment is vertically spaced above the leading edge by a distance D1 no less than 2.5 mm.

16. The iron-type golf club head recited in claim 15, wherein the distance D1 is no less than 7 mm.

17. The iron-type golf club head recited in claim 15, further comprising a loft angle no less than 40 degrees.

18. The iron-type golf club head recited in claim 15, wherein the first surface finish comprises a media-blasted surface or a milled surface.

19. The iron-type golf club head of claim 15, wherein the second surface finish comprises a finish selected from the group consisting of: a physical vapor deposited coating, a polished metallic coating, a black-colored coating, an anodized coating, a laser-etched coating, and a chemically-etched coating.

20. A golf club including the iron-type golf club head recited in claim 15, the golf club further comprising a golf shaft and a negative face angle.

* * * * *